United States Patent [19]

Schwartz

[11] Patent Number: 4,805,511

[45] Date of Patent: Feb. 21, 1989

[54] ELECTRONIC BELL-TONE GENERATING SYSTEM

[75] Inventor: Gregory L. Schwartz, Spinnerstown, Pa.

[73] Assignee: Schulmerich Carillons, Inc., Sellersville, Pa.

[21] Appl. No.: 186,763

[22] Filed: Apr. 22, 1988

Related U.S. Application Data

[63] Continuation of Ser. No. 899,435, Aug. 12, 1986, abandoned.

[51] Int. Cl.[4] ..... G10H 1/02; G10H 1/08

[52] U.S. Cl. ..... 84/1.22; 84/1.13; 84/1.26

[58] Field of Search ..... 84/1.01, 1.03, 1.11–1.13, 84/1.19–1.23, 1.26, DIG. 11

[56] References Cited

U.S. PATENT DOCUMENTS

| | | | |
|---|---|---|---|
| 3,940,635 | 2/1976 | Meyer | 84/1.26 X |
| 3,971,283 | 7/1976 | Wayne, Jr. | 84/1.26 |
| 4,119,006 | 10/1978 | Whitefield | 84/124 |
| 4,150,600 | 4/1979 | Deutsch | 84/1.13 |
| 4,228,714 | 10/1980 | Howell | 84/1.01 |
| 4,250,446 | 2/1981 | Southgate | 84/1.01 |
| 4,250,787 | 2/1981 | Segan et al. | 84/1.01 |
| 4,271,495 | 6/1981 | Scherzinger et al. | 84/1.26 |
| 4,326,276 | 4/1982 | Scott, Jr. | 84/1.01 |
| 4,387,622 | 6/1983 | Deutsch . | |
| 4,401,975 | 8/1983 | Ferguson et al. | 84/1.13 |
| 4,409,877 | 10/1983 | Budelman | 84/1.23 |
| 4,644,840 | 2/1987 | Franz et al. | 84/1.03 |

*Primary Examiner*—Stanley J. Witkowski

*Attorney, Agent, or Firm*—Woodcock Washburn Kurtz Mackiewicz & Norris

[57] ABSTRACT

An electronic bell-tone generating system selectively provides a plurality of bell tones having improved tonal quality includes a plurality of tone generators operated in preselected combinations by a microprocessor in response to inputs from a keyboard. Data representing characteristic bells, including a fundamental tone and associated partial tones, their initial amplitude, and decay rate, is stored within a random access memory, input periodically to the respective tone generators comprising double-buffered, digital-to-analog converters, and output simultaneously to produce the "strike" of a bell.

24 Claims, 11 Drawing Sheets

ELECTRONIC BELL-TONE GENERATING SYSTEM

This is a continuation of application Ser. No. 899,435, filed Aug. 12, 1986, and now abandoned.

BACKGROUND OF THE INVENTION

This invention relates generally to an electronic tone generating system, and more particularly to such a system for effectively reproducing a plurality of selected bell and chime tones of improved tonal quality.

The quality of musical tones produced by an instrument is generally determined by three basic properties of sound: pitch, tone color, and dynamics. Pitch, the "highness" or "lowness" of sound, depends on the speed or rate of the vibrations. The smaller the vibrating body, the faster the vibrations and the higher the sound (e.g., a piccolo encloses a smaller tube of vibrating air than does a trombone). As is well known, if one blows across the top of a bottle as it is filled up with water, the sound becomes higher as the vibrating column of air above the water becomes shorter.

The phenomenon of octaves has to do with the remarkable fact that strings and other sound-producing bodies tend to vibrate not only along their full length but also simultaneously in halves, quarters, and so forth. Acoustical physicists call these fractional vibrations "partials," while musicians call them "overtones." The sound of the overtones is very, very much softer than that of the fundamental note. But when a second string, half the length of the first, vibrates it also reinforces an overtone of the first (full-length) string. The ear receives this as a kind of "duplication."

Tone color, that indescribable quality of sound, depends on the amount and proportion of the overtones. In a flute, for example, the air column happens to vibrate largely along its total length and not much in halves or quarters, whereas violin strings vibrate simultaneously in many subsegments. This is what seems to account for the "white" tone color of the flute and the "rich" tone color of the violin.

Dynamics or loudness depends on the amplitude of the vibration, that is, on how far or hard the string or air column vibrates. For example, in a guitar, loudness depends on how many sixteenths or thirty-seconds of an inch the string flares out when it is plucked. The harder it is plucked, the louder the sound, of course. Players of wind instruments control dynamics by the wind pressure that they produce by blowing.

Generating sound by electronic methods on the other hand requires, first, the development of an electrical wave, and second, a means by which its energy can be used to produce audible sensations. To generate sounds having specific pitches and tones, the electrical waves have to be modified accordingly. Basically, this is what an electronic organ does. A basic electrical wave, such as a sine wave or a more complex saw tooth or pulse wave, is typically fed to a wave shaping network designed to produce an electrical wave which, when amplified and applied to a speaker, produces a sound having a specific pitch and tone.

Previous attempts to generate a bell-tone of substantial tonal quality have not been successful primarily because of their inability to generate the proper frequencies, or partials, contained within the bell-tone, and also because of their inability to individually control the attack and decay of the amplitude levels of the various frequencies contained therein. A bell-tone is essentially a "complex tone", that is, a sound wave produced by the combination of simple sinusodial components of different frequencies. Faithful reproduction of a bell-tone requires that the amplitude, attack, and decay of each one of the frequencies or partials involved in the bell-tone are able to be dynamically and interdependently changed based on which partial or related frequency the particular frequency is in relation to the fundamental frequency of the bell-tone.

The fundamental tone or frequency is variously described as the normal pitch of a musical tone, or the lowest frequency component of a complex waveform. As noted previously, a complex tone is made up of many simple sinusodial physical components of different frequencies. Each partial is, in turn, a sound sensation component that is distinguishable as a simple tone, cannot be further analyzed by the ear, and contributes to the character of the complex sound. The frequency of a partial may be higher or lower than the fundamental frequency and may be an integral multiple or submultiple of the fundamental frequency, as contrasted with a "harmonic" which is an integral multiple of the fundamental frequency. Therefore, in order to accurately reproduce a bell-tone of such tonal quality that the average listener could not distinguish the electronic bell-tone from a "real" bell sound, one is required not only to generate many frequencies, each related to the fundamental frequency of the bell, but also is required to individually control each one of the related frequencies as to its amplitude, attack, and decay.

An early attempt at incorporating the effects of attack and decay in a digital musical instrument is disclosed by Whitefield in U.S. Pat. No. 4,119,006. By appropriately scaling the digitally synthesized waveform information at the leading and trailing portions of the waveform envelope, Whitefield produces two attack and decay periods with only one of each resulting in the normal audible effect. One problem with such a system, as it pertains to the generation of bell-tones, however, is that it lacks the capacity for producing the characteristic "strike" of a bell since it indeed requires a predetermined length of time before the tone produced reaches its fullest intensity after the key has been depressed. In contradistinction, a real bell-tone has virtually no "attack" since it is dependent for its full intensity upon the percussive strike of its clapper.

Control of the "decay," or the length of time it takes for a tone to fade away after the playing key is released, has also been attempted in prior art devices with varying success. For example, Deutsch in U.S. Pat. No. 4,387,622 discloses a musical tone generator with independent time varying harmonics. A plurality of data words corresponding to the amplitudes of a corresponding number of evenly spaced points defining the waveform of one cycle of a musical signal are transferred sequentially from a note register to a digital-to-analog converter in repetitive cycles at a rate proportional to the pitch of the tone being generated. Thereafter, Deutsch discloses apparatus for approximating prespecified harmonic-time curves by piece wise segments of exponential functions. It is apparent, however, that such independent time varying harmonics are incapable of producing the required interdependency of a "real" bell-tone.

Electrical synthesis of a mechanical bell is also disclosed in U.S. Pat. No. 4,401,975—Ferguson. Circuit means are provided for synthesizing the sounds of a mechanical bell by combining the three most significant frequencies of the bell to be synthesized and modulating them with a decaying exponential control signal which is derived from a clock signal having a pulse repetition rate equal to the stroke repetition rate of the bell being synthesized. In a similar manner, Ferguson discloses in U.S. Pat. No. 4,437,088 an electronic circuit for simulating the sound of a percussive bell struck at a predetermined repetition rate. Both Ferguson patents, however, are directed to the type of bell that is ordinarily used as a household door bell. Accordingly, such devices are not suitable for the duplication of tonal characteristic of bells such as cast bells and chimes.

The advent of microprocessors has also enabled electronic devices to more faithfully reproduce musical instruments. For example, Budelman discloses in U.S. Pat. No. 4,409,877 a microprocessor-controlled electronic tone generating system for reproducing organ tones having improved harmonic content which includes a first group of tone generators having output frequencies defining a first musical scale, and second group of tone generators having output frequencies defining a second musical scale offset with respect to the first. The first group of tone generators is responsive to a keyboard operation (e.g., the actuation of a particular key) for generating the fundamental of the desired musical note as well as a first set of harmonic output frequencies. Likewise, the second group of tone generators is responsive to the same keyboard operation for reproducing a second set of harmonic output frequencies substituting for selected harmonic frequencies of the first set which fall outside predetermined error limits. In such a manner, the device simulates pipe organ sounds with thirty-two harmonics and two scales, the second scale reproducing "truer" 7th, 11th, 13th, 14th, 21st, 22nd, 25th, 26th, 28th and 31st harmonics. While such a device is capable of reproducing pipe organ voices with considerable accuracy, without inordinately increasing the number of tone generators in the system, it is nevertheless silent as to its applicability in the faithful reproduction of a variety of bell-tones. Furthermore, the mere reduction of the number of tone generators used to reproduce pipe organ voices, and correction for errors caused thereby, does not suggest the interdependent control of amplitude, attack, and decay of component partials in a complex tone such as bell-tone.

SUMMARY OF THE INVENTION

Accordingly, it is a general purpose and object of the present invention to provide an electronic bell-tone generating system which is capable of faithfully reproducing a plurality of bell and chime tones.

Another object of the present invention is to provide a computer-controlled, electronic bell-tone generating system for interdependently changing the amplitude, attack, and decay of a plurality of discrete partial tones which comprise a complex bell-tone.

A further object of the present invention is to provide a means for controlling an electronic bell-tone generating system in order that a variety of bell-tones having improved tonal qualities may be produced.

Briefly, these and other objects of the present invention are accomplished by an electronic bell-tone generating system including a plurality of tone generators, each of the tone generators being adapted to produce a discrete partial tone, and keyboard means for selectively energizing the tone generators in predetermined combinations to produce one or more complex tones, each of the complex tones comprising an interrelated plurality of discrete partial tones produced by one of the predetermined combinations including a fundamental tone representing a characteristic bell. The keyboard means also serves to diminish the amplitude of each of the partial tones according not only to its relationship to the fundamental tone, but also to the time elapsed since its respective tone generator was energized.

A keyboard, comprised of a plurality of switches, is scanned by scanning means for sequentially determining whether the switches are in an opened or closed condition. Thereafter, digital computer means such as a microprocessor, read only memory (ROM) for containing an operating program for the microprocessor, and random access memory (RAM), receives a "key depressed" signal from the scanning means, retrieves stored data from the ROM indicative of the depressed key, adjusts that data in accordance with a "stop tablet depressed" signal, and sends out an address to an address decoder matrix for strobing the appropriate tone generators. The tone generators capture and hold the data until its next update. In such a manner, the complex tone representative of a characteristic bell is comprised of a plurality of discrete partial tones each of which are initially turned on at a predetermined amplitude which is a percentage of a full-scale amplitude of the tone generators producing the bell's "strike," and each of which are decayed at a rate which is dependent not only upon the relationship of the respective partial to its fundamental tone, but also to the type of bell-tone selected.

Other objects, advantages and novel features of the invention will become apparent from the following detailed description of the invention when considered in conjunction with the accompanying drawings wherein:

BRIEF DESCRIPTION OF THE DRAWINGS

FIGS. *7a*, *7b*, *7c*, and *7d* comprise a flow diagram for the computer program used to operate a preferred embodiment of the electronic bell-tone generating system.

DESCRIPTION OF THE PREFERRED EMBODIMENT

Figure 1:
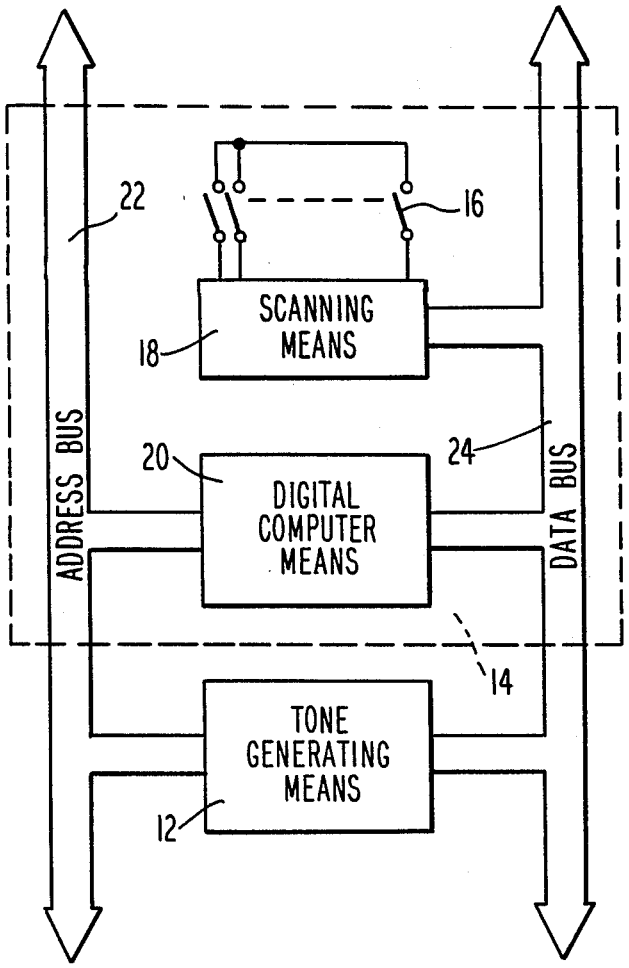
FIG. 1 is a representational diagram of an electronic bell-tone generating system according to the present invention.
Figure 6:
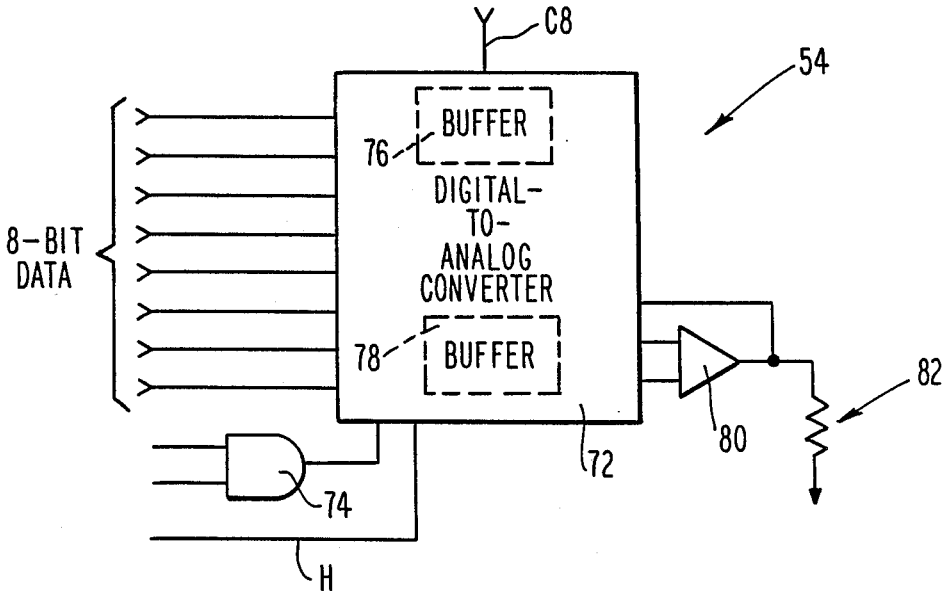
FIG. 6 is a block diagram of a preferred embodiment of an individual tone generator used in the tone generating means of FIG. 5.

Referring now to the drawings, wherein like characters designate like or corresponding parts throughout the several views, there is shown in FIG. 1 an electronic bell-tone generating system 10 which generally includes tone generating means 12 comprising a plurality of tone generators 54 (FIG. 6) and keyboard means 14 for selectively energizing the tone generators 54. The keyboard means 14 is further comprised of a plurality of switches 16 which are operatively coupled to a scanning means 18 for sequentially determining whether the switches 16 are in an opened or closed condition, and digital computer means 20, including an address bus 22 and a data bus 24, coupled between the tone generating means 12 and scanning means 18 for controlling the plurality of tone generators 54 included within the tone generating means 12 in response to the condition of the switches 16.

Figure 2:
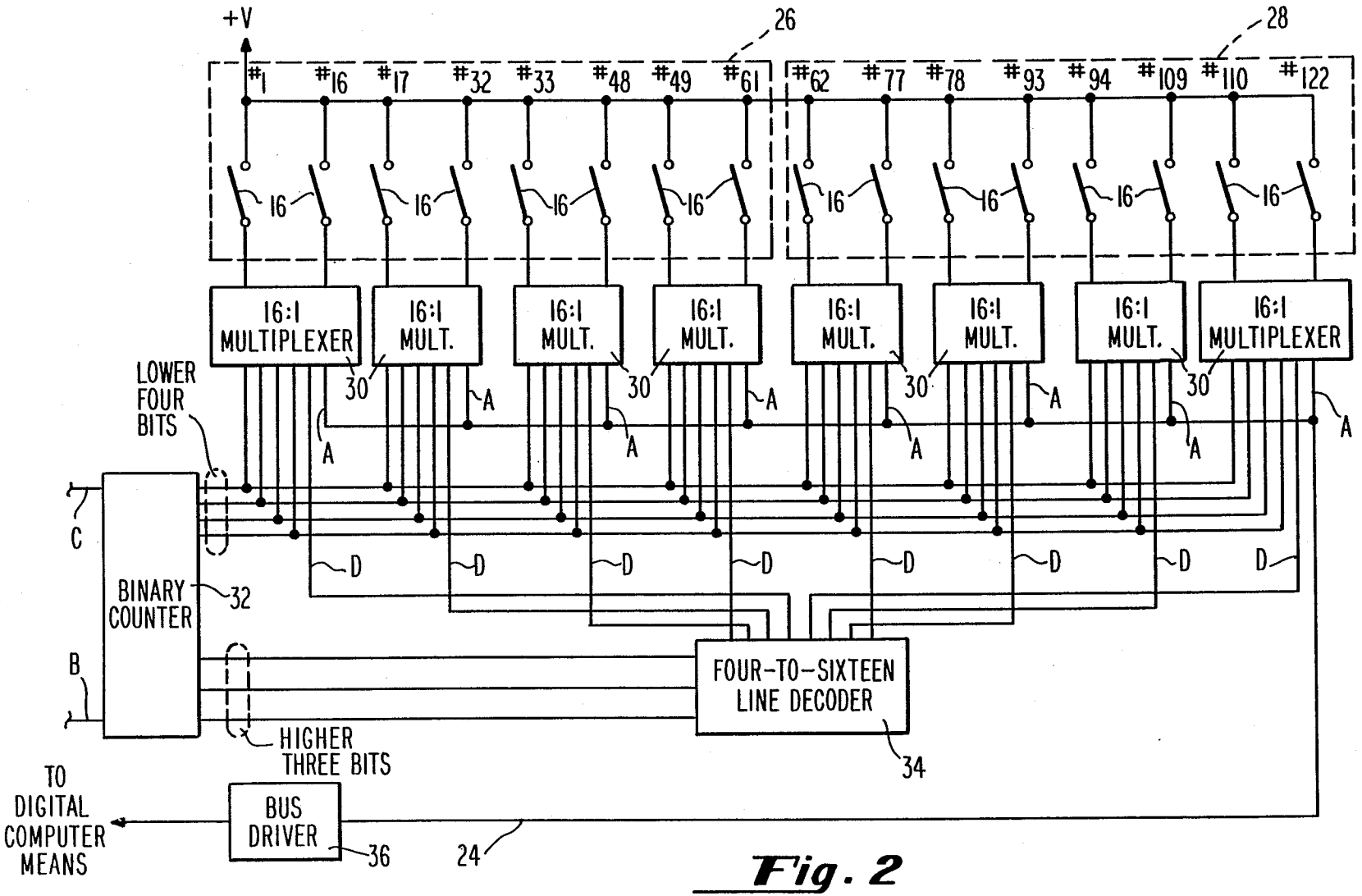
FIG. 2 is a block diagram of a preferred embodiment of the keyboard scanning circuit used in the scanning means of FIG. 1.

As is shown more clearly in FIG. 2, the switches 16 are arranged together in two groups of sixty-one, one group comprising a lower manual 26 and the other comprising an upper manual 28, although a greater or lesser amount of keys could be used without departing from the intent of the invention. The switches 16 are further coupled in groups of sixteen or less to a respective 16-to-1 multiplexer 30 for multiplexing the status of each switch 16 into a serial data stream signal A. Since this signal A is multiplexed, only one wire or bus 24 is necessary to carry the data for a multitude of key contacts or switches 16 which results in a tremendous cost savings when long cable runs of several hundred feet are used in a typical system for connecting the keyboard means 14 to the tone generating means 12.

In operation, each switch 16 is connected to the input of a respective 16-to-1 multiplexer 30, each multiplexer 30 being capable of scanning sixteen switches, although a greater or lesser number could be used if so desired. Initially, a binary counter 32 is reset to "zero" by a reset pulse B from the digital computer means 20, and is subsequently stepped in sequence at a scan rate determined by a clock signal C. The outputs of counter 32 are binary in nature, with the lower four bits being used to control the addressing of each of the multiplexers 30, and the next higher three bits being used to drive a 4-to-16 line decoder 34. The decoder 34 is used to sequentially enable each one of the eight multiplexers 30 via enabling signals D. The serial data stream signal A output from each multiplexer 30 is bussed together on the data bus 24 and input to a conventional bus driver 36 for input to the digital computer means 20.

Figure 3:
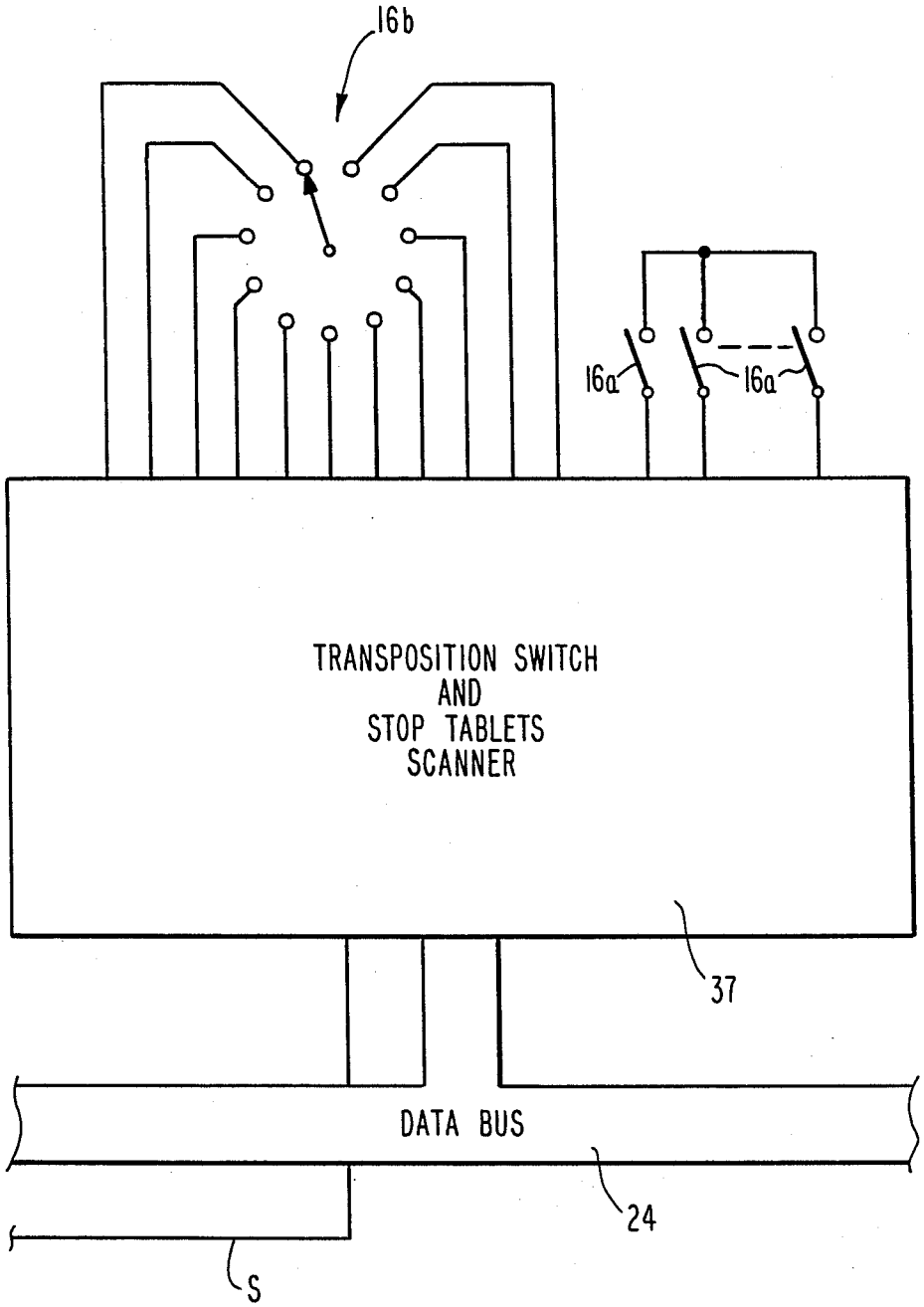
FIG. 3 is a block diagram of a typical transposition switch and stop tablet scanner used in the scanning means of FIG. 1.

In a similar manner, and referring now to FIG. 3, a plurality of stop tablet switches **16*a* and a transposition switch 16*b* are sequentially scanned and converted to a multiplexed serial data stream for input to the data bus 24 and for interpretation by the digital computer means 20 by a transposition switch and stop tablets scanner 37 strobed by a pulse S. The stop tablet switches 16*a* are selected dependent upon which type or types of bell-tones are desired to be heard, while the transposition switch 16*b*** allows a musician to play a musical arrangement in a different key from which it was written.

Figure 4:
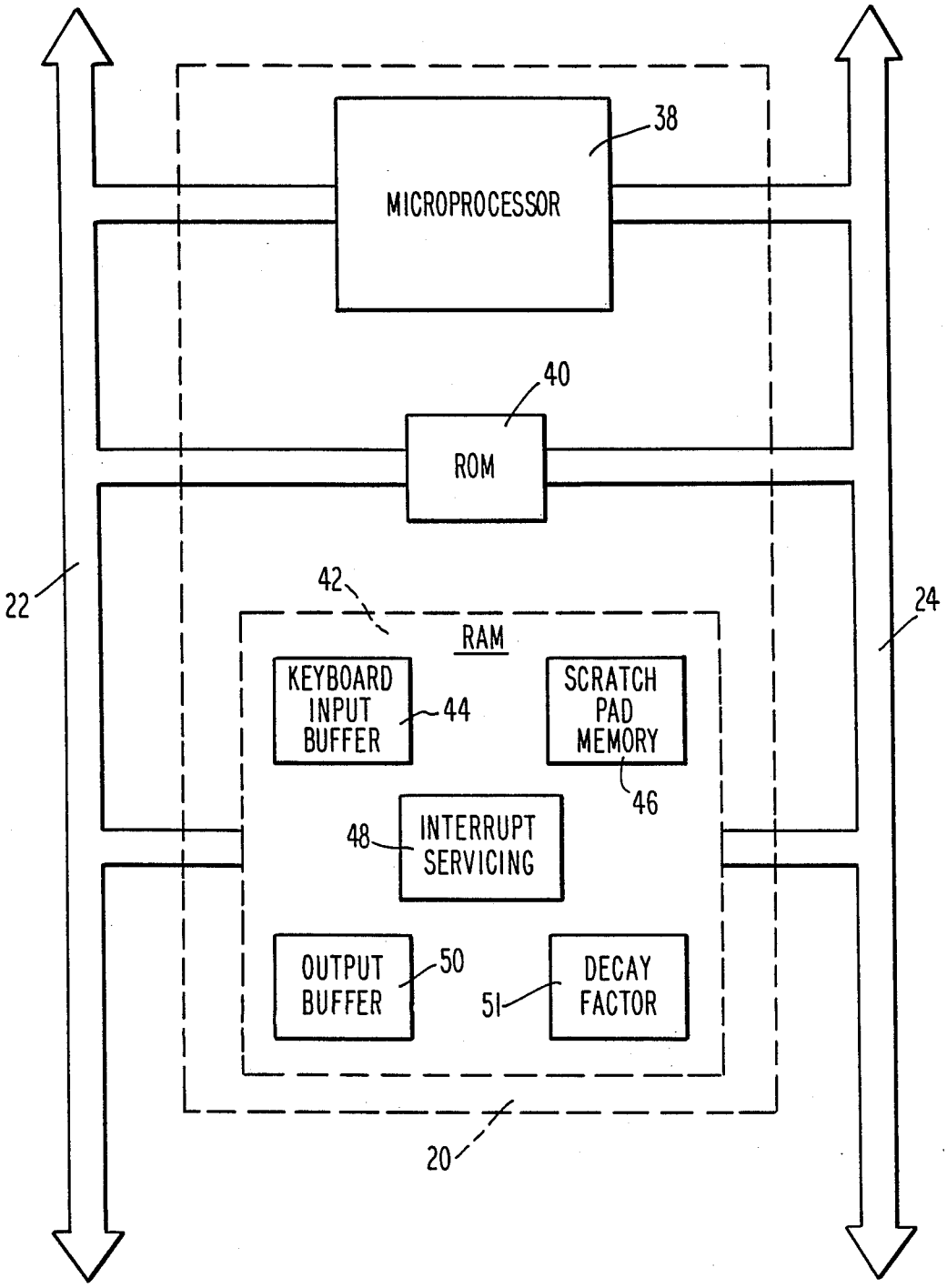
FIG. 4 is a block diagram of the digital computer means of FIG. 1.

As shown in FIG. 4, the digital computer means 20 further includes a microprocessor 38 intercoupled with a read only memory (ROM) 40 and a random access memory (RAM) 42. The microprocessor 38 may comprise any suitable eight-bit central processing unit, such as model number CDP-1805 manufactured by the Radio Corporation of America, as controlled by the operating program, discussed in algorithmic form with reference to FIGS. *7a*, *7b*, *7c*, and *7d*, which is contained with the ROM 40. The ROM 40 is used to contain not only the operating program for the microprocessor 38, but is also used for storage of the data necessary for bell-tone generation. A capacity of 32,768 words of eight-bits each is suitable for such purposes. Having a plurality of registers including at least a keyboard input buffer 44, a scratch pad memory 46, an interrupt servicing section 48, an output buffer 50 for the tone generators 54, and a decay factor portion 51, RAM 42 should be capable of storing 2048 words of eight-bits each.

Also attached to the data bus 24, as shown in FIG. **5*a* and 5*b*, are twelve tone generator boards 52, each consisting of up to eight individual tone generators 54. The number of tone generators 54 used is merely illustrative in nature, and is capable of producing ninety-six discrete partial tones, although a greater or lesser number could be used as so desired. In operation, the microprocessor 38 (FIG. 4) receives a signal along the data bus 24 from the scanning means 18 (FIGS. 1 and 2**) indicating that a key has been depressed. As will be explained more fully with reference to the discussion of FIGS. *7a*, *7b*, *7c*, and *7d* herein below, data associated with that particular key or switch 16 is retrieved by the microprocessor 38 from the ROM 40, and in accordance with the stop tablet switches **16*a* which are presently activated, is sent to the proper tone generators 54 as addressed by an address decoder matrix 58. Also passed to each appropriate tone generator 54 by way of the data bus 24 is data relating to the amplitude desired for each tone generator 54. Such data is captured by the tone generators 54 and held therein until the next group of data is subsequently passed to them. In accordance with one important aspect of this invention, up to thirty tone generators 54 may be enabled simultaneously to produce a particular bell-tone. However, a greater or lesser number of tone generators 54 may be enabled to produce a particular bell-tone without any changes other than to the operating program for the microprocessor 38 and the amount of data stored within the ROM 40. In such a manner, the tone generators 54 necessary to produce a particular bell-tone are each initially turned on at a predetermined amplitude level (i.e., a given percentage of a full-scale, or greatest, amplitude from the tone generators 54) which is read from the ROM 40**, and which produces the characteristic "strike" of a bell-tone.

In order to produce a bell-tone of improved tonal quality, each discrete partial tone must reach its initial amplitude level almost instantly and thence decay at a rate determined by the particular type of bell-tone being generated. Each partial decays at a different rate from the other, dependent not only upon the type of bell-tone, but also dependent upon which partial of the bell-tone the discrete partial is in relation to the fundamental frequency of the bell-tone (i.e., whether the first partial, the 15th partial, the 22nd partial, etc.). Such decay data is also contained within the ROM 40 for each bell-tone, and is retrieved by the microprocessor 38 as needed.

In accordance with another important aspect of this invention, the tone generators 54 are updated with new data sixty times a second, or at a selected variable rate, in order to produce the desired decay as will be further explained herein below. Although the amplitude levels of the discrete tones are dropped in small steps as opposed to a smooth decay, such steps are small enough so as to produce an apparently smooth decay as detected by the ear of the listener. In the most simplistic case, where only one key or switch 16 is depressed on the keyboard means 14, a group of tone generators 54 would initially be turned on, each at a particular amplitude level to produce the bell-tone. Each one of these levels would then be reduced or decayed interdependently. That is, the amplitude of each of the discrete partials is reduced dependent on the data contained within the ROM 40 which pertains to the particular type of bell-tone, as well as the relationship of the discrete partial to the fundamental frequency. In time, when all of the tone generators 54 have reached a zero amplitude level, they are turned off or disabled.

In reality, where a person would be playing a musical selection on the keyboard means 14, a large number of bell-tones would be produced. This requires that many or all of the tone generators 54 would be used simultaneously, each one at different amplitude levels and each one of those levels decaying at a different rate. It is only by nature of the microprocessor 38 being able to operate at a high rate of speed that such action is accomplished, the end result being that there is no detectable delay or "lag" upon depression of a key until the bell-tone is heard.

Referring again to FIG. 5*b*, each of the tone generator boards 52 containing eight tone generators 54 are fed a respective top octave frequency signal from a top octave generator 60, for example C8. The top octave frequency signals are suitably comprised of square waves of a frequency related to the top-most frequencies of a musical scale (e.g., C8—4186.009 Hz through B8—7902.132 Hz). Thus, each one of the tone generator boards 52 receives one top octave frequency signal which is both fed to one of the tone generators 54 contained on the board 52 and subsequently divided down seven times by a conventional divider circuit 62 to produce a total of eight octaves of a particular frequency of tone (e.g., C1–C8), each comprising a frequency input signal for a respective one of the tone generators 54. Since the top octave frequency may be suitably crystal derived, the accuracy of the musical notes produced as output signals is typically plus or minus one cent (where the interval between two adjacent notes is divided into 100 cents) or 0.003% deviation from the exact note.

Referring again to FIG. 5*a*, the outputs of the tone generators 54 (FIG. 5*b*) on tone generator boards 52 are connected in groups of twelve with a total of eight groupings. The included twelve frequencies, or tones, thus connected are summed together along respective filter busses 84 to produce a composite input to each respective filter 64. The filters 64 are necessary due to the fact that the outputs of the tone generators 54 are square waves, and may contain many related harmonic frequencies or tones above the desired frequency or tone. If such higher harmonics were allowed to be amplified as generated, a very distorted audio signal would be heard. Therefore, the higher harmonic frequencies are attenuated below the audible level through the filters 64.

While any low pass filter may be suitably employed for the filters 64, a CMOS switched capacitor filter of the seventh-order elliptical ladder type with an input cosine prefiltering stage is presently preferred within a device incorporating the invention disclosed herein. One suitable such filter is produced by American Microsystems, Inc. as model number AMI-S3528. The roll-off point of each filter 64 is selected as to pass unchanged the twelve frequencies of the fundamentals while attenuating any higher frequency as described herein above, thus reducing the unwanted higher harmonics to a level of at least 51 dB below the fundamental frequencies. The outputs of the eight filters 64 are summed together at the input of an operational amplifier 66 which provides a small amount of audio gain, and also provides a low-impedance source to drive the input to a power amplifier 68 whose output can be used to drive appropriate reproducing apparatus such as a loud speaker 70.

Figure 5A:
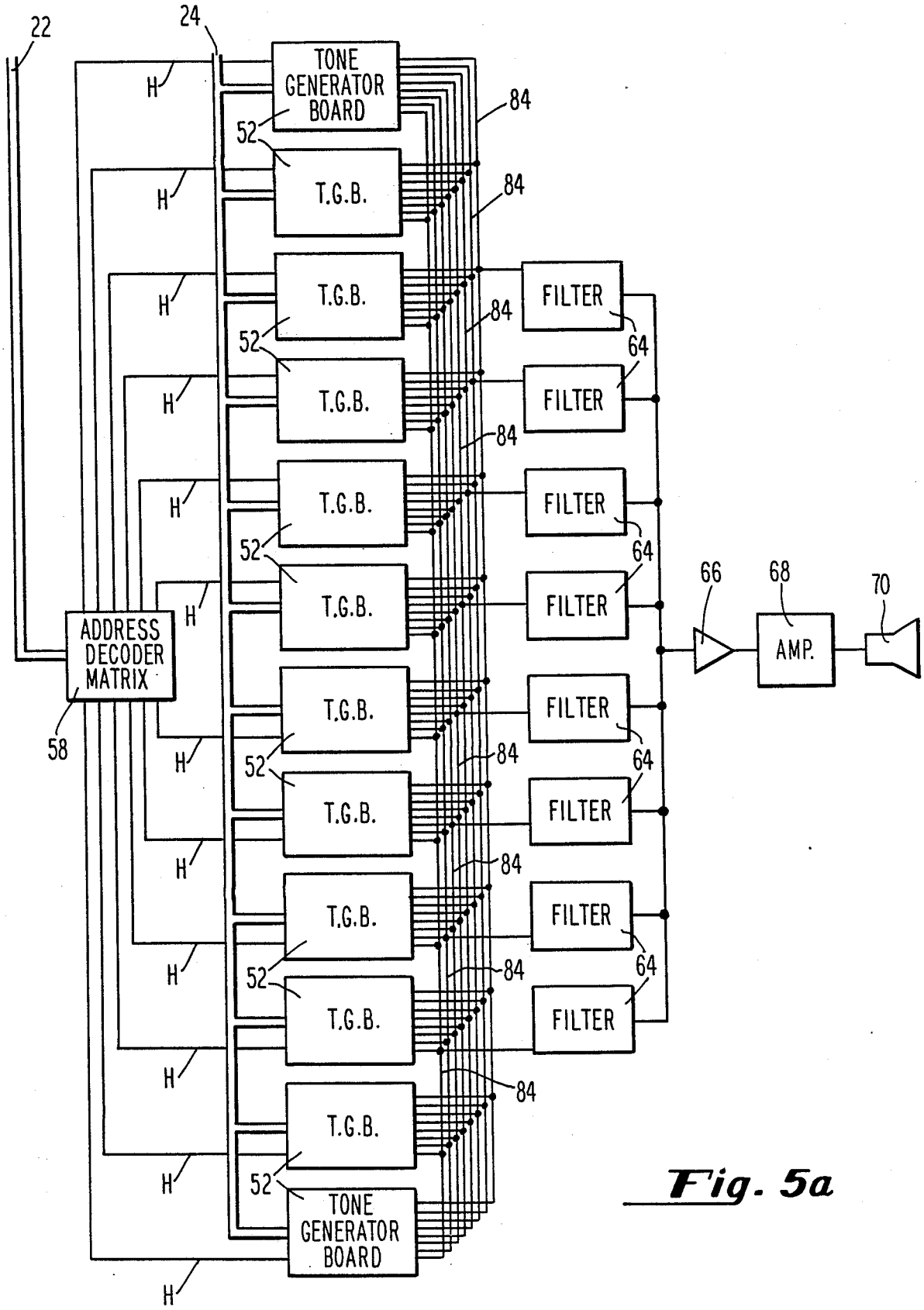
FIGS. 5*a* and 5*b* are block diagrams of the tone generating means of FIG. 1.
Figure 5B:
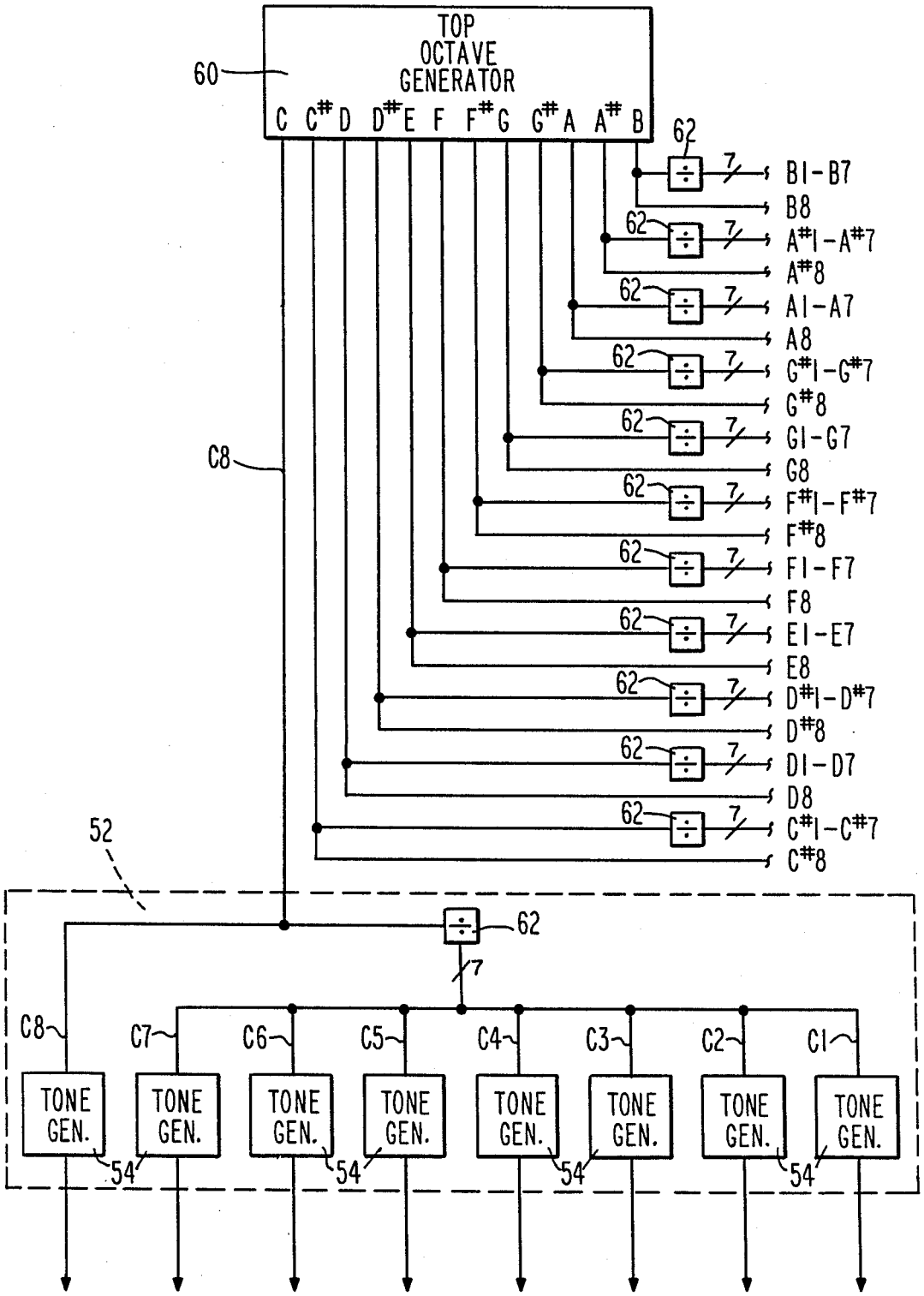

Referring again to FIG. 6, it can be seen that each of the tone generators 54 include a multiplying double-buffered digital-to-analog converter 72 presently used in the preferred embodiment as a gating level attenuator. In operation, the appropriate frequency input signal, for example C8, is fed as an input reference voltage in the form of a square wave of 50% duty cycle. The converter 72 is an eight bit R-2R ladder network using the frequency input signal as a reference voltage which is attenuated by an amount determined from an 8-bit data instruction relating to amplitude and passed to the converter 72 on the data bus 24 from the microprocessor 38. As such, the converter 72 is used as a "variable resistor" which merely level modulates the square wave input. Since eight bits of binary data are available, a total of 256 discrete levels beneath the greatest, or full-scale amplitude are possible. Being of the double-buffered type, the converter 72 first latches the eight-bit binary number passed to it from the data bus 24 when a strobe pulse H is generated by the address decoder matrix 58 (FIG. 5*a*) for the particular converter 72 in conjunction with gating circuitry 74. Such data, representing the desired amplitude level, is latched into the first buffer 76 of the converter 72, with the output of the converter 72 still representing old data until such time as all of the converters 72 have been loaded with new data. At that point, a second strobe pulse H is generated by the address decoder matrix 58 which transfers the data from the first buffer 76 to a second buffer 78, thus changing the outputs of each converter 72 simultaneously. Since the output of the converter 72 is a current, proportional to the input data passed through the data bus 24 and gated by the reference voltage, this output current is converted to a voltage by way of a low-noise amplifier 80, thereafter being passed through a resistor 82 to one of eight filter busses 84 (FIG. 5*a*).

As mentioned previously, data is presented to all of the tone generators 54, sixty times a second or every 16.67 milliseconds. In an exemplary case, the converter 72 is turned on at an 80% amplitude level (i.e. 80% of the full-scale, or greatest, amplitude) initially and then reduced every 16.67 milliseconds by 1%, until such time that the amplitude level has reached zero, whereupon the converter 72 is then disabled until needed again for another bell-tone generation. In the instance thus illustrated, a decay of 1% every 16.67 milliseconds would produce a 1.33 second decay from the initial level of 80% amplitude down to a zero amplitude. Of course, this is only by way of illustration and any level or decay rate may be used. Moreover, at any point in the decay, the converter 72 can be strobed with new amplitude data if the particular tone generator 54 is to be used for a different bell-tone. As a result, the tone generator 54 would decay at a new rate as determined by the newest bell-tone being generated.

Figure 7A:
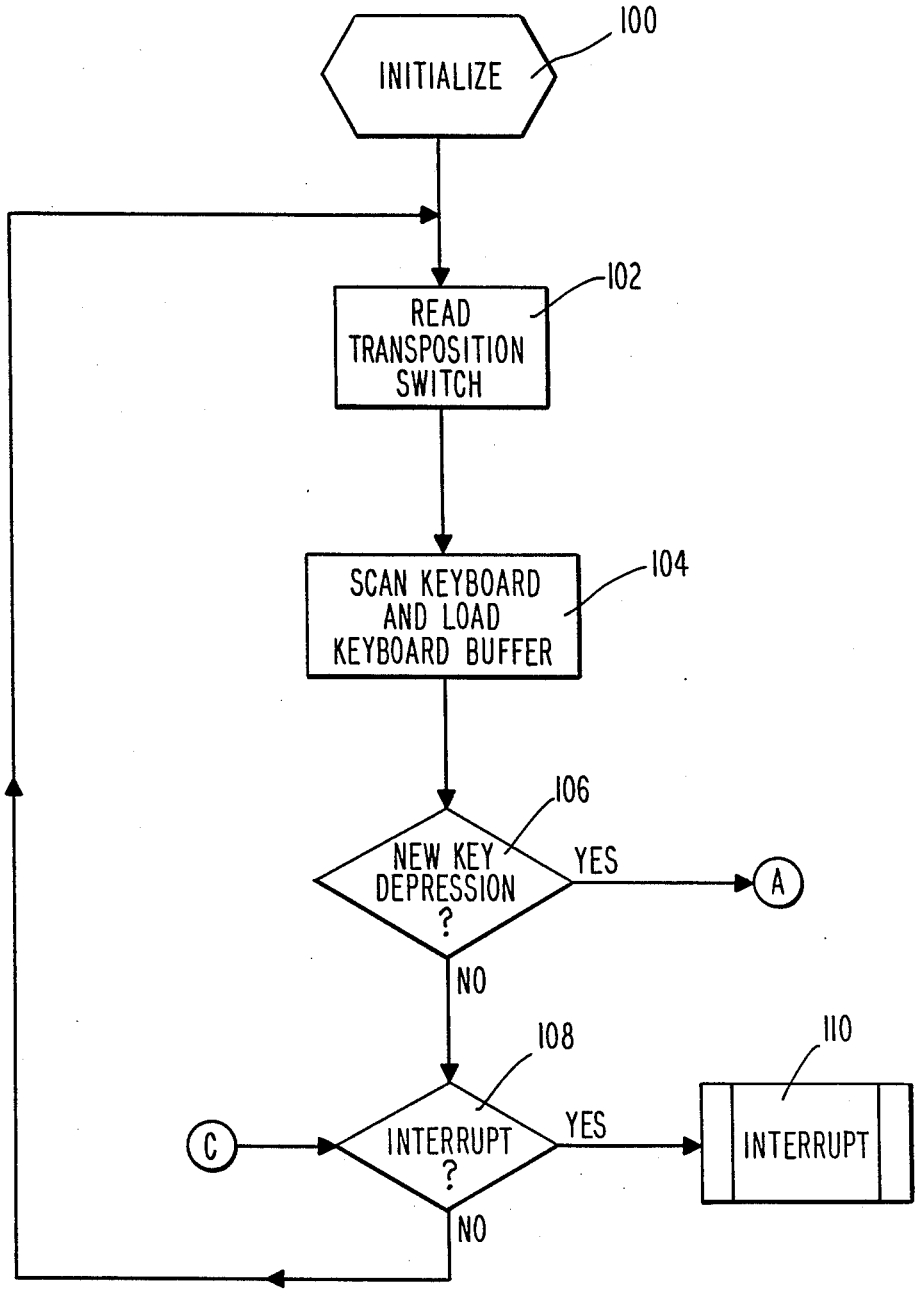
Figure 7B:
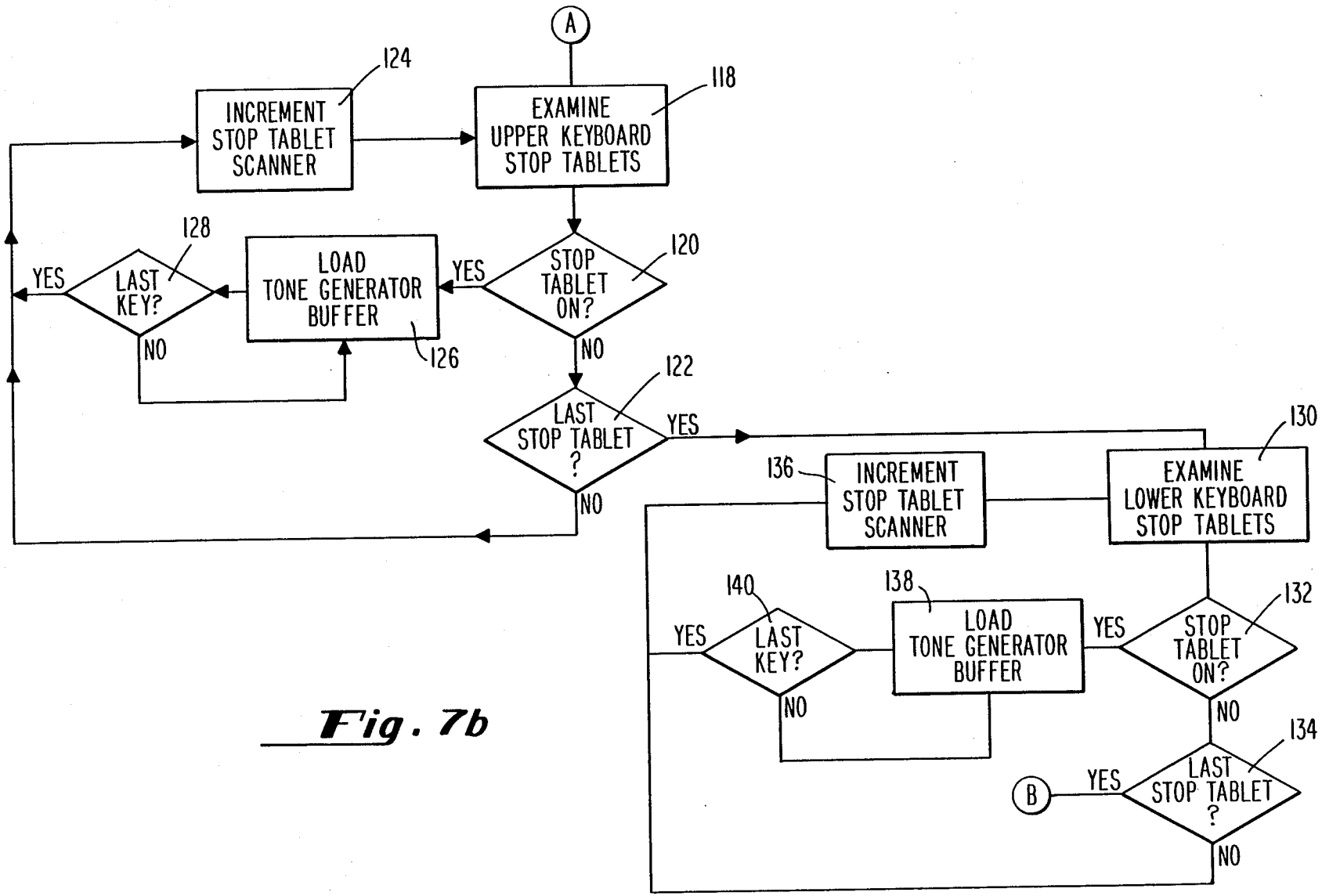

Reference is now made to FIGS. 7*a*, 7*b*, 7*c*, and 7*d* to indicate the manner in which the microprocessor 38 is programmed. As shown in FIG. 7*a*, the first step in the program is indicated as 100, and is referred to as "initialize". This step 100 is invoked upon power up or when the system 10 (FIG. 1) is reset, thus causing the internal registers of the microprocessor 38 (FIG. 4) to be initialized to their appropriate addresses, and all of the RAM 42 to be erased. The tone generators 54 are also loaded with "zero" data and reset so as not to produce a tone until needed. In such a condition of operation, no sound will be produced. After initialization, the program is stepped to a "read transposition switch" step 102 in which the transposition switch 16*b* is scanned and an offset made to change the key in which the bell-tone is to be played. The effect of the transposition switch 16*b* is thus to shift a key being played up the musical scale to play a different bell-tone in the system 10. It should be noted that the transposition switch 16*b* may be omitted from the system 10, in which case the system 10 will sound the notes as played with no corresponding transposition.

Each key switch 16 on the keyboard means 14 is then examined for a closure (i.e., key down) or absence of a closure (i.e., key up) status in the "scan keyboard" step 104. Such data is sent to the microprocessor 38 as previously described in a serial data stream. If the key or switch 16 is activated (down), the microprocessor 38 will load the keyboard input buffer 44 with such "key down" data. On the other hand, if the key or switch 16 is not activated (up), the data is loaded into the keyboard input buffer 44 as "key up". Unlike an organ which produces a tone for as long as a key is held down, a bell-tone system must produce a "strike" upon the initial closure of a key switch 16, and subsequently decay in amplitude to a zero amplitude, regardless of how long the key or switch 16 is held down. For this reason, when the data is loaded into the keyboard input buffer 44 as "key down" data, the RAM 42 is first checked to determine whether that particular key 16 was down on the previous scan of the keyboard. If such key 16 was previously down, the data in the RAM 42 is changed to indicate that it is a "repeat key down" and not a new depression. During a subsequent portion of the program when the bell-tones are produced, this modified data will prevent the repeat generation of the same bell-tone. If this were not done as described, the bell-tone would be produced as a fast series of strikes for as long as the key was held down. In the event that a new key 16 has been depressed since the last scan of the keyboard means 14, a flag is set in the microprocessor 38 to indicate a new key depression. This leads to the next step in the program called the "new key depression?" step 106, which checks the flag previously mentioned for data indicating a new key depression. If the flag indicates that there was not a new key depression during the last scan of the keyboard means 14, the program goes on to the step labeled "interrupt?" 108.

As discussed previously herein above, the tone generators 54 are turned on at an initial amplitude level depending upon which key 16 is depressed and also what type of bell is being played. After the initial turn on, the tone generators 54 are updated sixty times a second with new data caused by an interrupt to the microprocessor 38. Such an interrupt branches the microprocessor 38 to a subroutine indicated generally at 110 and shown more clearly in FIG. 7*d*. If an interrupt has occurred since the last keyboard scan was initiated, the interrupt subroutine 110 will be asserted causing the microprocessor 38 to retrieve from the output buffer 50 for the tone generators 54 the data presently within the individual tone generators 54, and modify it according to the data contained within the decay factor portion 51 of the RAM 42. After updating all the tone generators 54, at step 112 (FIG. 7*d*), the tone generators 54 are strobed at step 114 and the program is returned to the main program at step 116. If at step 108 an interrupt has not been asserted, the program returns to the read transposition switch step 102 as previously described. It should be noted at this juncture, that a branch to the interrupt subroutine as shown in FIG. 7*d* is only allowed to occur during step 110 and not during any other time in the program. This prevents the program from stopping in the middle of a keyboard scan, branching to the interrupt subroutine, and then returning back to where the program was suspended.

Referring again to FIG. 7*a*, if at step 106 the flag data indicates that a new key 16 was activated since the last scan of the keyboard, the program then proceeds with step 118 (FIG. 7*b*) to examine the upper manual or keyboard's stop tablets. During such procedure, the first stop tablet switch 16*a* for the upper manual 28 is scanned to determine if it is activated at step 120. If not, the program then proceeds to step 122 to decide if such stop tablet is the last one to look at in the upper manual 28 or not. If not, the scanning means 18 is incremented at step 124 and the program returns to step 118 to examine the next stop tablet 16*a* for the upper manual 28. This procedure repeats until a stop tablet 16*a* is found to be activated, whereupon the program branches to step 126, labeled "load tone generator buffer", in which the microprocessor 38 reads the keyboard input buffer 44 to determine which key or keys 16 are to be played. When a key 16 is found to be activated in the keyboard input buffer 44, the data is examined to determine whether or not this is a new key depression or a repeat depression. If a repeat key is indicated, the key is then ignored. Otherwise, the data indicates that a new key has been depressed, the microprocessor 38 will add an offset equivalent to the transposition, and a fixed, predetermined offset to indicate the address offset for a particular type of bell to be played as indicated by the stop tablets 16*a*. The microprocessor 38 will then retrieve from the ROM 40 the data indicating which tone generators 54 are to be turned on, as well as their initial amplitude level. This data is then loaded into the output buffer 50 for subsequent loading into the tone generators 54 proper. The microprocessor 38 also retrieves from the ROM 40 the data indicating the decay factor for each partial and, then loads this data into the decay factor portion 51 of the RAM. This procedure is repeated for each key, which is indicated by the data within the keyboard input buffer 44 as being a new key depression for the upper keyboard.

When the last keyboard input buffer 44 for the upper manual 28 has been read, as determined at step 128, the program returns to step 118 after incrementing the stop tablet scanner at step 124. This procedure repeats until all the stop tablets 16*a* for the upper manual 28 have been examined, at which time a jump is made in the program as indicated at step 122. This entire procedure of examining the stop tablet switches 16*a*, reading the keyboard input buffer 44, and loading the tone generators 54 is repeated for the lower manual 26 exactly as for the upper keyboard (see steps 130, 132, 134, 136, 138, and 140). Thus, the above procedure allows each key depression to simultaneously generate a number of different bell tones dependent upon which stop tablets 16*a* are presently activated.

Figure 7C:
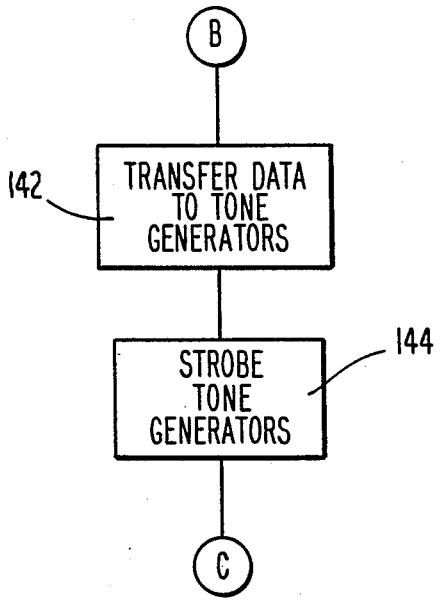
Figure 7D:
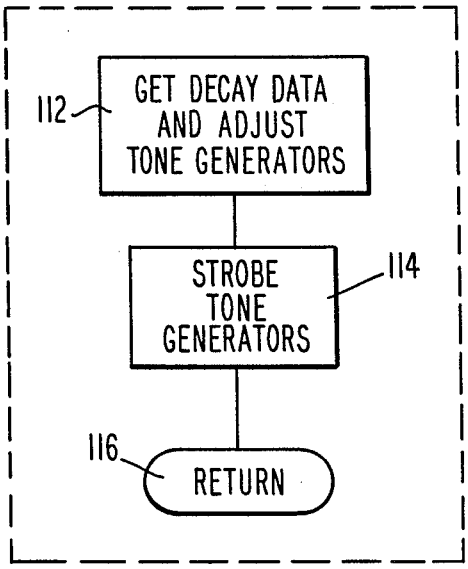

The only difference from the above description is that when the last stop tablet for lower manual 26 has been examined at step 134, the program jumps to the step labeled "transfer data" at step 142 (FIG. 7*c*). During the program step, the output buffer 50 for the tone generators is examined to determined which tone generators 54 are to be turned on and at what amplitude level. The microprocessor 38 uses such data to load the tone generators 54, and after all the tone generators 54 are loaded with the new data, they are strobed at step 144 to "dump" all the tone generators 54 simultaneously. This instantaneous turn on of all tone generators 54 produces the characteristic "strike" of a bell.

The program then returns to step 108 (FIG. 7*a*) as indicated to check for an interrupt. If an interrupt has been asserted, the program branches to the interrupt subroutine 110, or if no interrupt has been generated the program repeats the above mentioned procedure for scanning the keyboard means 14, loading the tone generators 54, and strobing those tone generators 54 to produce the bell-tone. It should be appreciated that due to the speed of the microprocessor 38, the time lapse involved between depression of a key until the bell-tone is heard is virtually instantaneous.

Figure 8A:
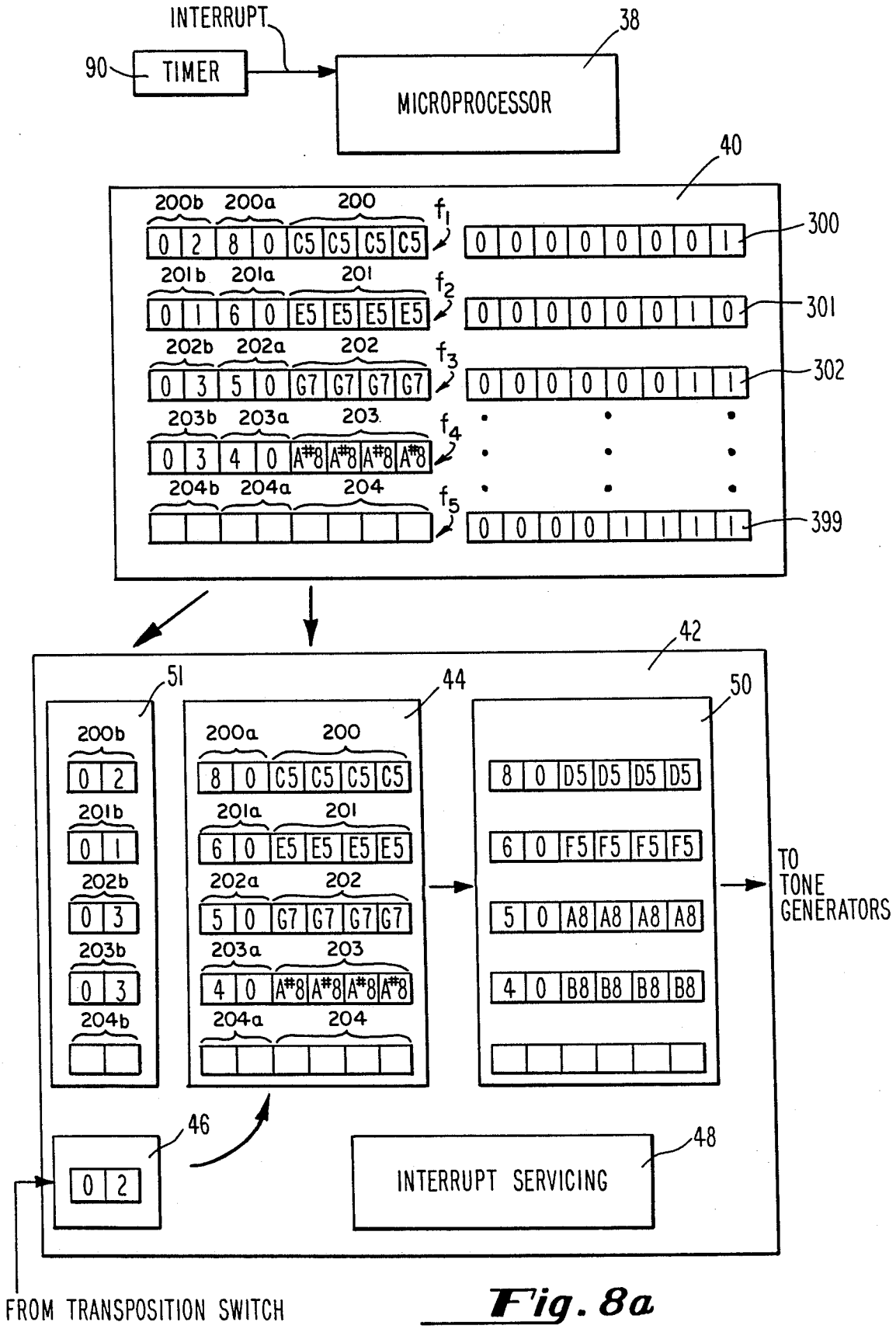
FIGS. 8*a* and 8*b* illustrate a means for generating decay according to the present invention.
Figure 8B:
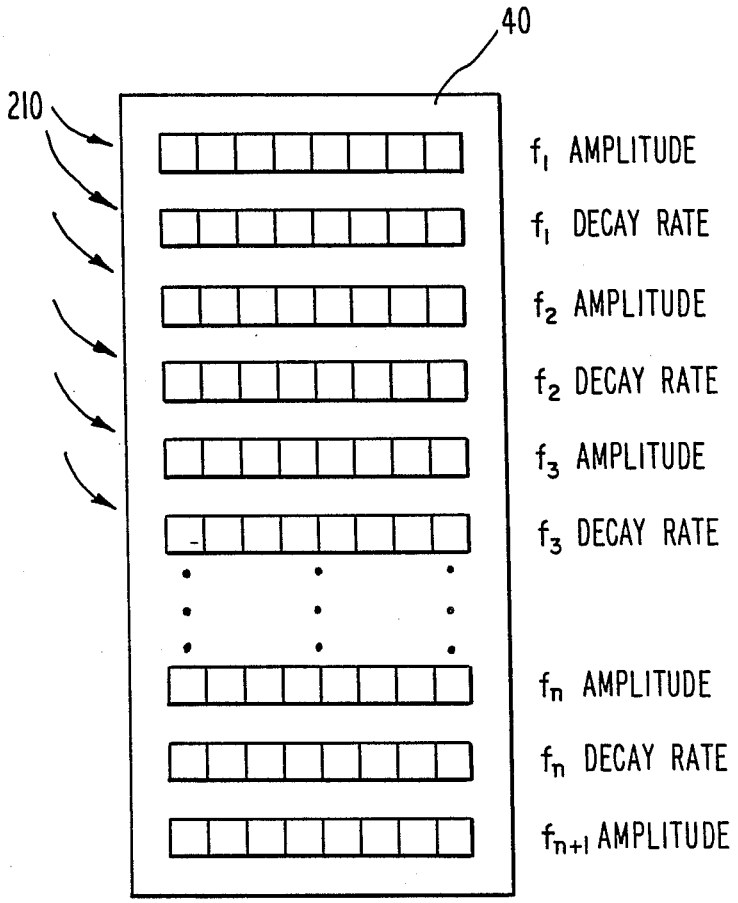

Having described in some detail the structural and functional relationship of the individual components which comprise the present invention, the following will illustrate how the data stored in the ROM 40 and RAM 42 is manipulated to produce the decay which is necessary to replicate the tone of a variety of bells. Referring now to FIGS. 8*a* and 8*b*, a plurality of addresses 200, 201, 202, 203, and 204 resident in the ROM 40 are representative of five discrete frequencies f1–f5 which may be used to reproduce a bell tone. Each of the addresses 200–204 may further comprise a portion 200*a*–204*a* indicative of the initial amplitude at which its respective tone generator 54 will be turned on as well as a portion 200*b*–204*b* indicative of the amount of decay which will occur per interrupt sequence. Alternatively, individual multi-bit addresses 210 as shown in FIG. 8*b* may be used to indicate the discrete frequencies f1–f5, their respective initial amplitudes, and decay rates as shown in FIG. 8*a*.

Also resident in the ROM 40 is the operating program for the microprocessor 38, represented as addresses 300–399. The program shown thus sequentially implements the algorithm shown in FIGS. 7*a*, 7*b*, 7*c*, and 7*d*. For example, in the case where a bell-tone having C5 as a fundamental tone and E5, G7 and A #8 as the interrelated partials corresponding to the C5 fundamental, addresses 200–203 respectively represent the addresses in ROM 40 which contain the data for activation of the selected partials, C5, E5, G7 and A #8. When a switch 16 corresponding to C5 is played, and the appropriate stop tablet 16*a* activated thereby combining the C5 fundamental with its E5, G7, and A #8 partials to produce a selected bell tone, the scanning means 18 under control of the microprocessor 38 detects such switch conditions, reads the corresponding addresses 200*a*–203*a* from ROM 40 and transfers that data to the RAM 42 in the output buffer 50. Likewise, data relating to the addresses for the decay rates 200*b*–203*b* are read by the microprocessor 38 and loaded in the decay factor portion 51 of the RAM 42. If a shift in the key played is made by activation of the transposition switch 16*b*, a corresponding offset may be loaded into the scratch pad memory 46.

When each of the switches 16 and stop tablets 16*a* have been scanned, and offsets made to the addresses stored in the keyboard input buffer 44 according to data stored in the scratch pad memory 46, the adjusted data is transferred under control of the microprocessor 38 to the tone generator output buffer 50. Thereafter, and upon strobing controlled by the microprocessor 38, the respective tone generators 54 corresponding to the data in the output buffer 50 are loaded with the data and as previously described herein energized to produce a bell-tone.

An interrupt timer 90 generates an interrupt signal at selected time intervals, for example sixty times per second, and inputs the interrupt signal to the microprocessor 38. As referred to herein before with reference to FIGS. 7*a*, 7*b*, 7*c*, and 7*c*, the microprocessor 38 will acknowledge and store the interrupt signal until such time that the interrupt sub-routine (FIG. 7*d*) may be implemented; that is, only after an entire keyboard scan has been completed. Thereafter, the microprocessor 38 under control of the main operating program stored in the ROM 40 at addreses 300–399 will read that portion loaded into the RAM 42 in the interrupt servicing section 51 and perform that subroutine.

The data contained within the output buffer 50 are read to obtain the last data sent to the tone generators 54. That data is subsequently adjusted in one of the registers located in the RAM 42 according to the decay rate data contained in the decay factor portion 51. For example, if the data 00101 corresponded to the last amplitude data for a given tone generator 54, and the decay factor offset was 00002, then the new data to be loaded into the output buffer 50 for further loading to its respective tone generator 54 would be 00099, representing the same discrete frequency at a diminished amplitude. Each of the frequencies C5, E5, G7, and A #8 would be adjusted accordingly, but not necessarily at the same decay factor. That is, each frequency would be adjusted interdependently according to its relationship to the fundamental. By the term muscially-scaler relationship, it should by understood that the relationship of a particular discrete tone to its fundamental tone is determined by the relative frequency of that discrete tone to the fundamental frequency. If G7, for instance, was a partial for a different fundamental, for purposes of illustration D3, its decay rate might be entirely different. The means for generating such decay is, therefore, non-frequency dependent.

Obviously, many modifications and variations of the present invention are possible in light of the above teachings. For example, the use of the term "bell" herein applies equally to cast bells, Flemish bells, English bells, the harp, celesta, and Quadra bells as well as chimes. It is therefore to be understood that within the scope of the appended claims, the invention may be practiced otherwise than as specifically described.

What is claimed is:

1. An electronic bell-tone generating system, comprising:

a plurality of tone generators, each said tone generator producing, upon its energization, a discrete tone having a full-scale amplitude;

keyboard means for energizing one or more predetermined combinations of said plurality of tone generators to produce one or more bell tones, each said bell tone comprising said discrete tones produced by a selected one of said one or more predetermined combinations that is characteristic of a given bell, said discrete tones that are produced by each said selected combination including a fundamental tone which is representative of a normal pitch of said given bell, and at least one discrete tone other than said fundamental tone having a frequency below said fundamental tone; and decay generating means for interdependently diminishing the amplitude of each said discrete tone produced by each said selected combination according to a musically-scalar relationship of each said discrete tone produced by each said selected combination to its respective fundamental tone, each said discrete tone produced by each said selected combination thereby decaying at a decay rate that is independent of the decay rate of that same discrete tone in the others of said selected combinations.

2. An electronic bell-tone generating system according to claim 1, wherein said keyboard means comprises:

a plurality of switches;

scanning means for sequentially determining whether said switches are in an opened or closed condition; and digital computer means, including an address bus and a data bus, coupled between said tone generators, and said scanning means for controlling said tone generators in response to the condition of said switches.

3. An electronic bell-tone generating system according to claim 2, wherein said plurality of switches comprises:

a plurality of key-operated switches representing the notes of a musical scale; and a plurality of tablet-operated switches representing stops.

4. An electronic bell-tone generating system according to claim 3, further comprising:

a transposition switch for selectively changing the key in which a musical arrangement is played.

5. An electronic bell-tone generating system according to claim 2, wherein said scanning means comprises:

a binary counter connected to receive a reset signal and a clock signal from said computer means;

a plurality of multiplexers bussed together at their outputs, each of said multiplexers connected at their inputs to a predetermined number of said switches; and line decoder means connected between said binary counter and said multiplexers for sequentially enabling said multiplexers;

wherein said binary counter, upon receipt of said reset signal and under the control of said digital computer means, steps through said switches at a scan rate determined by said clock signal thereby producing a serial data stream representing the condition of each of said switches.

6. An electronic bell-tone generating system according to claim 5, further comprising:

a bus driver connected to receive said serial data stream for amplifying said serial data stream and routing same to said digital computer means.

7. An electronic bell-tone generating system according to claim 2, wherein said digital computer means further comprises:

a central processing unit coupled to said address bus and said data bus;

read only memory means coupled to said address bus and said data bus for storing a program that is adapted to operate said central processing unit and for containing data relating to the generation of each said bell tone, said program and said data including a plurality of addresses corresponding to a decay rate and initial amplitude data for each said discrete tone produced by each said selected combination; and random access memory means coupled to said address bus and said data bus for buffering inputs from said keyboard means and outputs for said tone generators, for temporarily storing data relating to each said discrete tone produced, and for providing each said tone generator said temporarily-stored data to said tone generators for independent control thereof.

8. An electronic bell-tone generating system according to claim 1, further comprising:

a top octave generator for producing a first plurality of signals corresponding to an uppermost desired musical scale; and frequency divider means receiving said first plurality of signals for producing a second plurality of signals corresponding to said uppermost desired muscical scale and a predetermined number of octaves below said scale.

9. An electronic bell-tone generating system according to claim 8, wherein each of said second plurality of signals is fed to a respective one of said plurality of tone generators.

10. An electronic bell-tone generating system according to claim 7, wherein said decay generating means comprising:

means for transferring said data from said read only memory means to said random access memory means, said transferring means operatively coupled to said scanning means;

means for loading said plurality of tone generators with said data from said random access memory means; and means for strobing said plurality of tone generators to simultaneously energize each said tone generator that is loaded with said data.

11. An electronic bell-tone generating system according to claim 10, further comprising:

means for periodically adjusting said data buffered in said random access memory means, said adjusting means operatively coupled to said strobing means, wherein said amplitude data buffered in said random access memory means for each said discrete tone is changed, thereby reducing the amplitude of each said discrete tone output from each respective tone generator according to a respective decay rate for each said discrete tone produced by each said selected combination.

12. An electronic bell-tone generating system according to claim 11, further comprising:

means for adding or subtracting an offset to said data, wherein said offset represents a change in the respective decay rates of said discrete tones in one said bell tone from said stored decay rates in said read only memory means corresponding to each said selected discrete tone in another bell tone.

13. An electronic bell-tone generating system according to claim 11, wherein said adjusting means offset said amplitude data sixty times per second.

14. An electronic bell-tone generating system according to claim 11, wherein said adjusting means offset said amplitude data at a selected variable rate.

15. A bell-tone generator, comprising:

tone generating means for producing a plurality of discrete tones;

a keyboard having a plurality of key-operated switches representing notes of a musical scale; and digital computer means, operatively coupled between said tone generating means and said keyboard, said digital computer means including a microprocessor, first memory means for storing data relating to generation of a plurality of selected bell tones, each said bell tone comprising said discrete tones produced by said tone generating means in a predetermined combination thereof characteristic of a given bell, said discrete tones that are produced by each said combination including a fundamental tone which is representative of a normal pitch of said given bell, and at least one discrete tone, other than said fundamental tone, having a frequency below said fundamental tone, second memory means for storing instructions relating to the operation of said microprocessor, means to identify in response to the operation of one of said switches said fundamental tones of each given bell, and means to enable said tone generating means for the simultaneous production of respective ones of said discrete tones which correspond to one or more given bells, said enabling means including amplitude changing means for reducing the amplitude of each said discrete tone produced by said tone generating means in each said combination according to said data stored in said first memory means;

wherein, each said discrete tone produced by each said combination decays at a rate that is independent of the decay rate of that same discrete tone in the others of said combinations.

16. A bell-tone generator according to claim 15, further comprising:

selection means coupled to said digital computer means for changing the response thereof to said keyboard in accordance with a particular type of bell.

17. A bell-tone generator according to claim 15, further comprising:

a transposition switch for selectively changing the key in which a musical arrangement is played.

18. A bell-tone generator according to claim 15, wherein said keyboard further comprises;

scanning means for sequentially determining whether said switches are in an opened or closed condition, said scanning means including a binary counter connected to receive a reset signal and a clock signal from said digital computer means, a plurality of multiplexers bussed together at their outputs, each of said multiplexers connected at their inputs to a predetermined number of said switches, and line decoder means connected between said binary counter and said multiplexers for sequentially enabling said multiplexers, wherein said binary counter, upon receipt of said reset signal and under the control of said digital computer means, steps through said switches at a scan rate determined by said clock signal thereby producing a serial data stream representing the condition of each of said switches.

19. A bell-tone generator according to claim 18, further comprising:

a bus driver connected to receive said serial data stream for amplifying said serial data stream and routing same to said digital computer means.

20. A bell-tone generator according to claim 15, wherein said tone generating means comprises:

a top octave generator for producing a first plurality of signals corresponding to an upper most desired musical scale;

frequency divider means receiving said first plurality of signals for producing a second plurality of signals corresponding to said upper most desired musical scale and a predetermined number of octaves below said scale; and a plurality of tone generators coupled to said frequency divider means, wherein each of said second plurality of signals is fed to a respective one of said plurality of tone generators, said tone generators each including double latching means for receiving a digital input from said digital computer means.

21. A bell-tone generator according to claim 20, wherein said double latching means comprises:

a double-buffered digital to analog converter receiving binary data representing a desired amplitude from said digital computer means in a first buffer, wherein said binary data is transferred to a second buffer upon receipt of a strobe pulse from said digital computer means, thereby changing the outputs of each of said converters simultaneously.

22. A bell-tone generating system, comprising:

a plurality of electronic tone generators, each said tone generator including a double-buffered digital to analog converter adapted to produce upon its energization a discrete tone having a selectable initial amplitude;

a keyboard comprising a plurality of key operated switches representing the notes of a musical scale;

scanning means for sequentially determining whether said switches are in an opened or in a closed position; and microprocessor means, including a random access memory and a read only memory, for selectively energizing said tone generators in a plurality of predetermined combinations thereof to produce more than one bell tones, each said bell tone comprising said discrete tones produced by a selected one of said plurality of predetermined combinations that is characteristic of a given bell, said discrete tones that are produced by each said selected combination including a fundamental tone which is representative of a normal pitch of said given bell, and at least one discrete tone, other than said fundamental tone, having a frequency below said fundamental tone, wherein each said discrete tone produced by each said combination is decayed from its respective selectable amplitude according to said decay data contained in said read only memory, each said discrete tone produced by each said selected combination thereby decaying at a decay rate that is independent of the decay rate of that same discrete tone in the others of said selected combinations.

23. A bell-tone generating system according to claim 22, further comprising:

means for changing data stored in said random access memory indicating that a scanned switch is in a repeat key down condition; and means for setting a flag in said microprocessor means to indicate a new key depression.

24. A bell-tone generating system according to claim 23, wherein said random access memory further comprises:

interrupt servicing means receiving said new key depression indication for modifying said binary data input to said tone generators in accordance with a factor which interdependently decays the output therefrom based upon a musically-scaler relationship of each said discrete tone produced by each said combination to its respective fundamental tone representing each given bell, as well as a time elapsed since its respective tone generator was energized.

* * * * *

UNITED STATES PATENT AND TRADEMARK OFFICE

CERTIFICATE OF CORRECTION

PATENT NO. : 4,805,511

DATED : February 21, 1989

INVENTOR(S) : Schwartz

It is certified that error appears in the above-identified patent and that said Letters Patent is hereby corrected as shown below:

Column 12, line 32, please change "muscially-scaler" to -- musically-scalar--

Column 14, line 17, please change (second half of word musical) "cical" to --ical--.

Column 14, line 25, please change "comprising" to --comprises--

Column 16, line 63, please change "scaler" to --scalar--

Signed and Sealed this

Twenty-second Day of August, 1989

*Attest:*

*Attesting Officer*

DONALD J. QUIGG

*Commissioner of Patents and Trademarks*